US007404477B1

(12) United States Patent
Toennisson et al.

(10) Patent No.: US 7,404,477 B1
(45) Date of Patent: Jul. 29, 2008

(54) PROXIMITY HAND RAIL MONITOR FOR A MOVING WALKWAY

(76) Inventors: H. Eugene Toennisson, 3102 Calusa Dr., Hamilton, OH (US) 45011; Kyle A. Apperson, 585 Foxglove Ct., Maineville, OH (US) 45039; Richard D. Rodich, 6509 State Route 132, Goshen, OH (US) 45122

( * ) Notice: Subject to any disclaimer, the term of this patent is extended or adjusted under 35 U.S.C. 154(b) by 0 days.

(21) Appl. No.: 11/065,673

(22) Filed: Feb. 24, 2005

Related U.S. Application Data

(60) Provisional application No. 60/547,828, filed on Feb. 26, 2004.

(51) Int. Cl.
*B66B 29/04* (2006.01)
*B66B 21/02* (2006.01)

(52) U.S. Cl. ..... 198/335; 198/323

(58) Field of Classification Search ..... 198/322, 198/323, 335, 336, 337, 338
See application file for complete search history.

(56) References Cited

U.S. PATENT DOCUMENTS

| | | | | | |
|---|---|---|---|---|---|
| 4,976,345 | A * | 12/1990 | Adrian et al. | ..... | 198/323 |
| 5,092,446 | A * | 3/1992 | Sullivan et al. | ..... | 198/323 |
| 5,361,887 | A * | 11/1994 | Zaharia et al. | ..... | 198/323 |
| 6,015,038 | A * | 1/2000 | Stoxen et al. | ..... | 198/322 |
| 6,112,166 | A * | 8/2000 | Joosten | ..... | 702/185 |
| 6,334,522 | B2 * | 1/2002 | Haruta et al. | ..... | 198/322 |
| 7,225,912 | B1 * | 6/2007 | Toennisson et al. | ..... | 198/323 |

* cited by examiner

*Primary Examiner*—Mark A Deuble
(74) *Attorney, Agent, or Firm*—Frost, Brown Todd LLC

(57) ABSTRACT

The present invention discloses and teaches method and apparatus for the detection of a disengaged, moving, handrail on a people moving walkway particularly an escalator. By the present invention a proximity sensor is positioned beneath the handrail for detection of a handrail that has become disengaged from its underlying guide rail. Upon detection of a disengaged handrail, the proximity sensor sends an electrical signal to a controller which stops the escalator or walkway.

5 Claims, 4 Drawing Sheets

PROXIMITY HAND RAIL MONITOR FOR A MOVING WALKWAY

RELATED PATENT APPLICATIONS

This application claims priority of U.S. Provisional Patent Application Ser. No. 60/547,828 filed on Feb. 26, 2004 and titled "Escalator Hand Rail Monitor."

BACKGROUND OF THE INVENTION

The present invention generally relates to a people moving walkway such as an escalator or any other people moving conveyor having a moving floor and an elevated, generally parallel, moving hand rail. More particularly the present invention relates to apparatus and method for detecting a handrail that has become disengaged from its underlying guide track.

Although the embodiment described and taught herein primarily illustrates the present invention as being applied to the handrail of a rising, or descending, stair escalator, it is to be understood that the present invention may also be used on any "closed loop," people moving walkway having a parallel moving handrail.

Although escalators and people moving walkways are periodically inspected, it is possible for a moving handrail to become disengaged from its underlying guide rail accidentally or through the act of vandalism. Therefore, it is desirable to have a means for detecting a handrail that has become disengaged from its underlying guide rail during operation of the walkway and to immediately stop operation of the walkway and/or send a malfunction signal to a controlling authority. The controlling authority may comprise an open loop system having a human operator monitor, or may comprise a closed loop system having a microprocessor controller.

The present invention teaches a method and apparatus for detecting the separation of a handrail from its underlying guide rail. Upon detecting a disengaged handrail the walkway may be immediately stopped by directly shutting of the electrical power to the walkway's driving motor or by sending an electrical signal to a to an open loop or closed loop controlling authority whereby the walkway may be stopped until a repair is made.

DETAILED DESCRIPTION OF THE INVENTION

Figure 1:
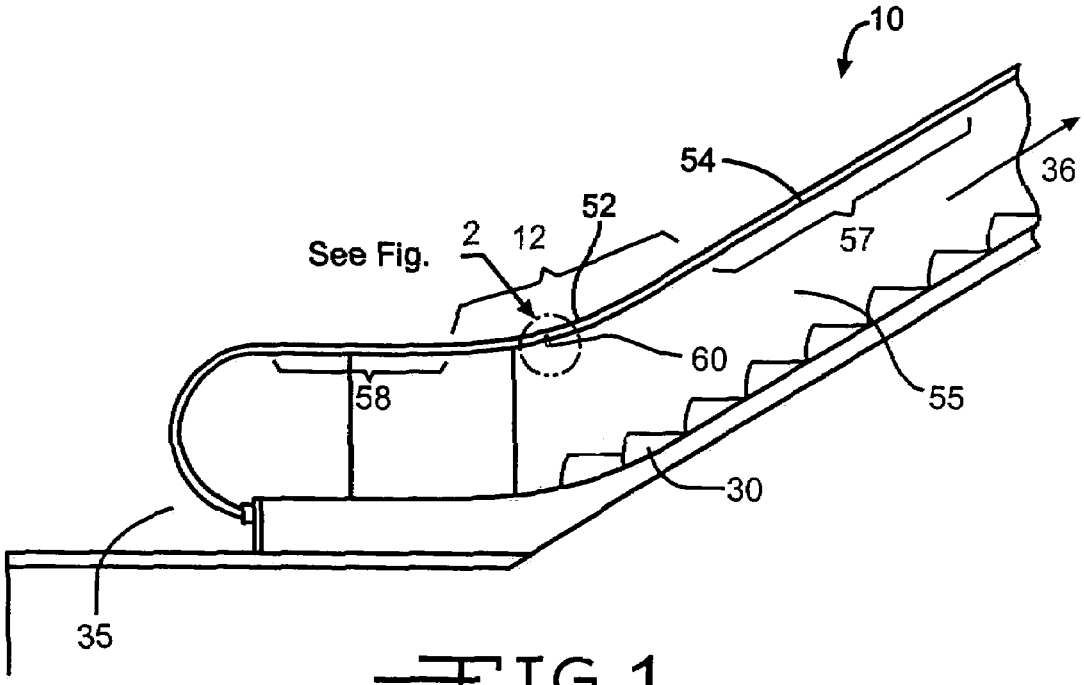
FIG. 1 presents a side elevational schematic view of a typical escalator embodying the present invention.
Figure 2:
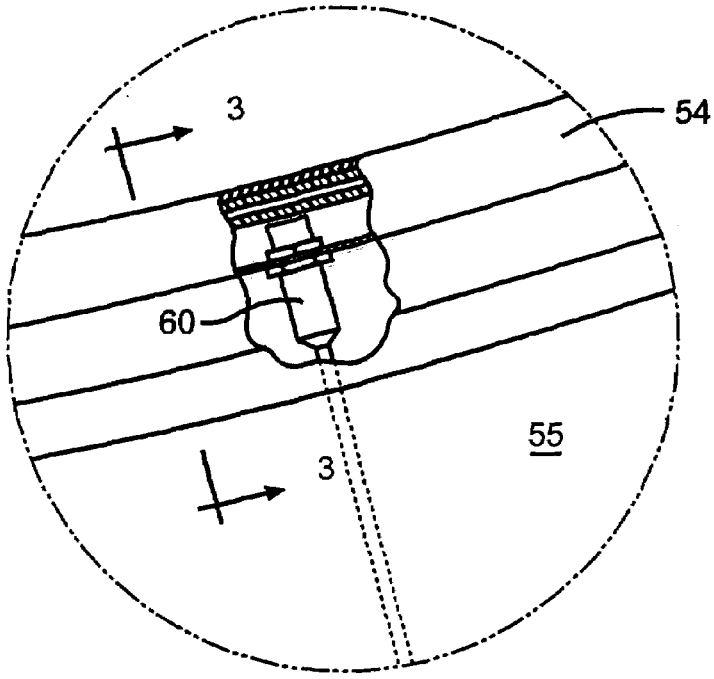
FIG. 2 presents an enlarged view of the circled area in FIG. 1.
Figure 3:
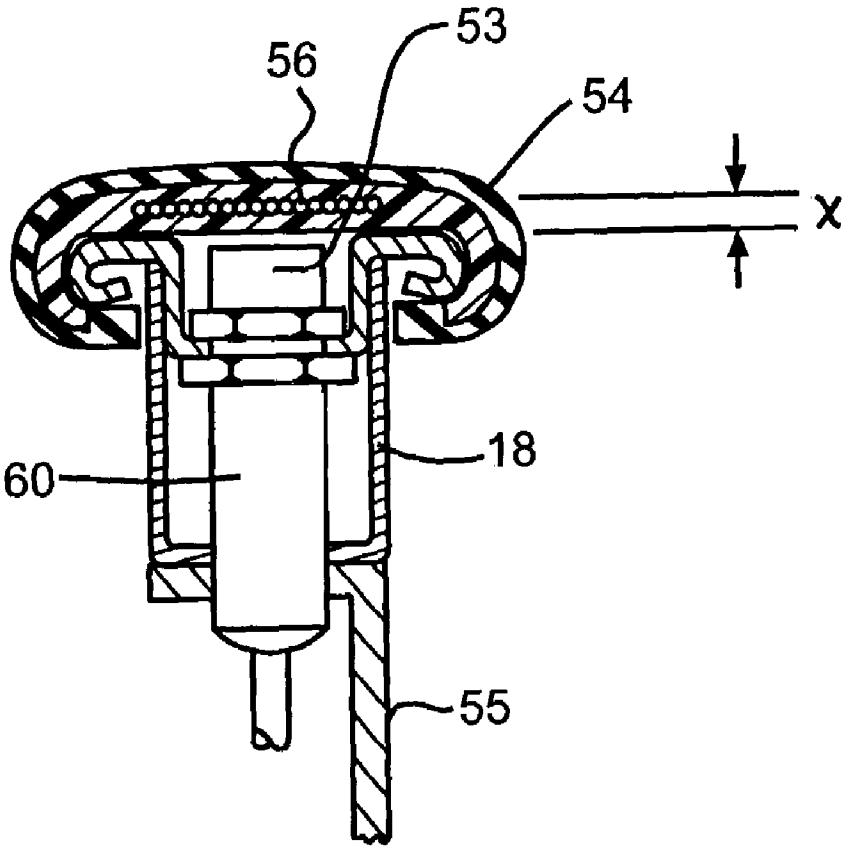
FIG. 3 presents a crossectional view taken along line 3-3 in FIG. 2.

FIG. 1 presents a schematic elevational view of a typical escalator 10 having an entry end 35 and an exit end 36 (not shown) and including a moving treadway 30 positioned between two parallel balustrades 55. A parallel moving handrail 54 is typically positioned atop balustrades 55 as illustrated in FIG. 3. An inductive proximity sensor 60 is installed within the handrail's concave, transitional curve area 52 of escalator handrail 54. FIGS. 2 and 3 illustrate the desired positioning of inductive proximity sensor 60 on the underside of handrail 54. Although the installation of proximity sensor 60 is described, and illustrated herein, as being positioned within concave transition area 52, proximity sensor 60 may also be positioned within the straight line portions 57 and 58. However, for an escalator, the best location for positioning proximity sensor 60 is believed to be within curved transition area 52 as is explained in greater detail below.

As illustrated in FIG. 3, an escalator handrail 54 typically includes continuous, longitudinally extending, metallic, stretch inhibiting, wires 56 embedded within the elastomeric material of hand rail 54. Positioned under handrail 54 and within handrail guide 18 is an inductive, proximity sensor 60. Handrail guide 18 is typically attached to the escalator balustrade as illustrated in FIG. 3. Sensor 60 is selected and positioned, with respect to handrail 54, such that metallic wires 56 lie within the sensing range of inductive sensor 60 during normal operation of the escalator.

As long as handrail 54 remains on handrail guide 18, as illustrated in FIG. 3, metallic wires 56 remain at a predetermined distance x from the sensing head 53 of sensor 60. As long as metallic wires 56 remain within the sensing range of sensor 60 proximity sensor 60 senses the presence of metal wires 56 whereby an electrical signal is transmitted to the escalator control unit 70 (see FIG. 5) permitting the escalator to continue operating.

Figure 4:
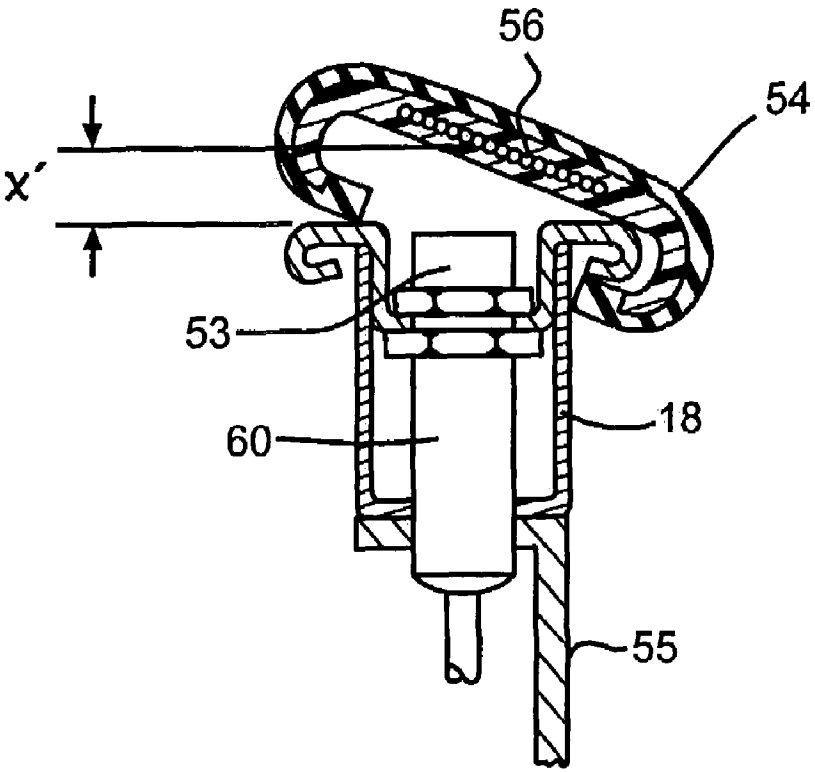
FIG. 4 presents a crossectional view, similar to that shown in FIG. 3, wherein the handrail is illustrated as having become disengaged from its underlying guide rail.

However, in the event handrail 54 becomes disengaged from handrail guide 18, as illustrated in FIG. 4, the metallic, stretch inhibiting, wires 56 are now at a distance x' from the sensing head 53 of sensor 60 whereby metal wires 56 are beyond the sensing range of sensor 60. Sensor 60 now transmits an electrical signal to the escalator control unit causing the escalator to stop operation.

Once the handrail is repaired and the stretch inhibiting wires 56 are again within the sensing range of proximity sensor 60, operation of the escalator may be restored.

It is considered most desirable to locate proximity sensor 60 within the handrail transition area 52 since the inherent tension within handrail 54 will cause the greatest separation x' between sensor head 53 and anti-stretch wires 56. In the event vandals force handrail 54 from its underlying guide rail 18, as illustrated in FIG. 4, within the straight running portions 57 and 58, the inherent tension within handrail 54 will cause handrail 54 to peel from guide rail 18 similar to that of an automotive tire bead being removed from the mounting flange of a typical automobile wheel and thereby rapidly travel to the handrail transition area 52 of handrail 54.

Figure 5:
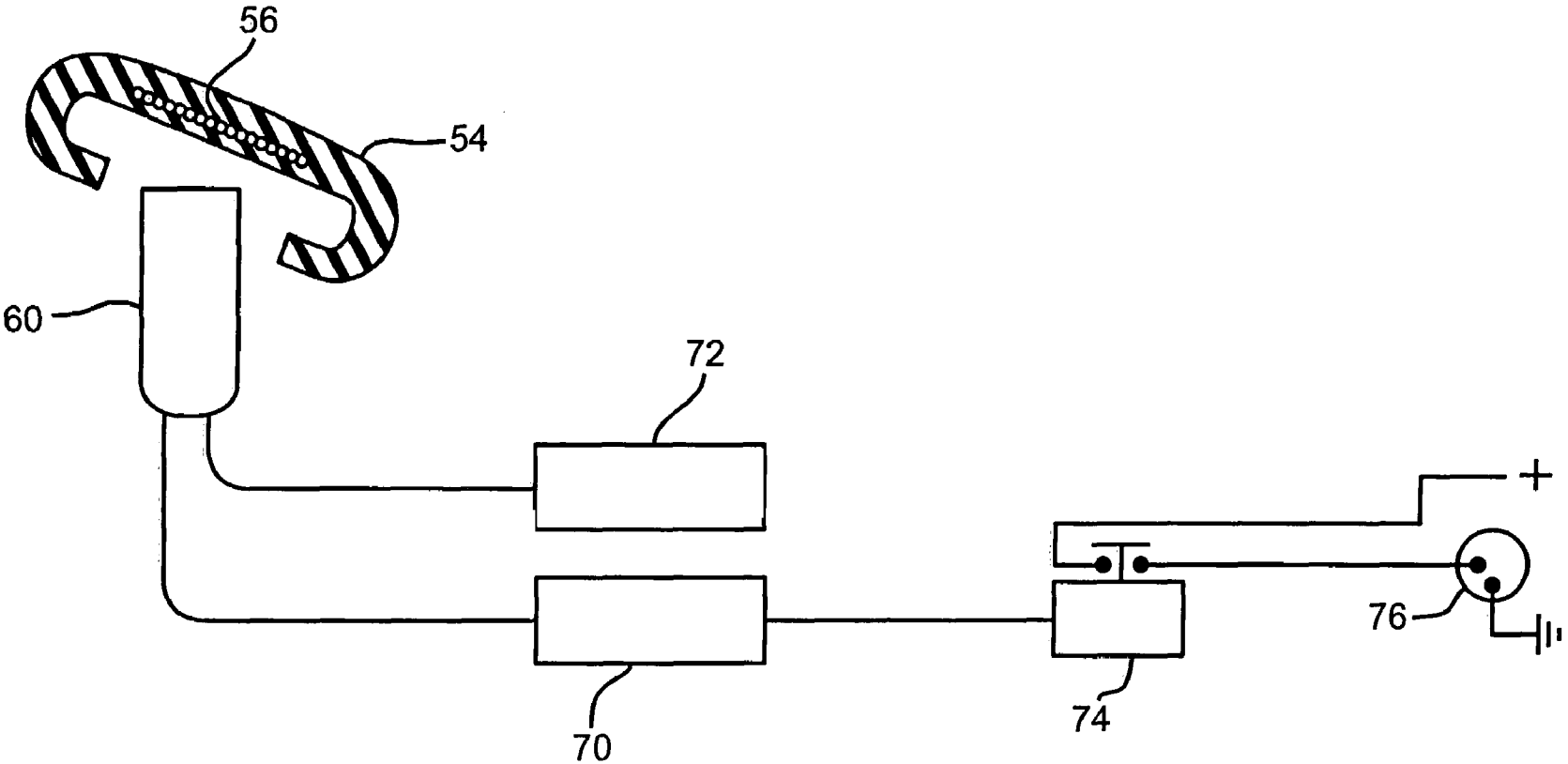
FIG. 5 presents an electrical schematic for the present invention.

FIG. 5 presents a simple wiring circuit illustrating an electrical power supply 72 for providing electrical power to inductive proximity sensor 60 positioned beneath hand rail 54 and its imbedded metallic wires 56. As long as proximity sensor 60 senses the presence of metallic wires 56 within its sensing range, an electrical signal is transmitted to control unit 70 which in turn closes, or retains closed, electrical contact switch 74 thereby providing electrical power to escalator motor 76.

However, in the event handrail 54 becomes disengaged from guide rail 18, as illustrated in FIG. 4, proximity sensor 60 ceases out put of an "all is well" electrical signal to control unit 70 whereby control unit 70 opens electrical contact switch 74 (as illustrated in FIG. 5) thereby stopping escalator driving motor 76 and continued operation of the escalator.

Although an inductive proximity sensor in cooperation with embedded metallic anti-stretch wires s taught herein it is also conceivable that other proximity sensors may be used. For example in the event textile fiberglass reinforcing filaments were used in place of metallic anti-stretch wires, an ultrasonic proximity sensor may be used. Also in some applications it may be desirable to use an ultrasonic proximity sensor in place of an inductive proximity sensor regardless of the type of embedded anti-stretch elements used within the handrail.

It is to be understood that the forms of the invention shown and/or described herein are but illustrative embodiments of the invention and that various changes and modifications can be made therein by one of ordinary skill in the art without departing from the spirit or scope of the appended claims.

We claim:

1. An escalator for the conveyance of passengers from the entry end of said escalator to the exit end of said escalator, said escalator comprising:

a) a moving treadway for the conveyance of passengers thereon, b) a pair of parallel balustrades, one on either side of said treadway, c) a moving handrail, associated with each of said balustrades, said handrails generally comprising a "C" shaped crossection wherein the open portion of said "C" shaped crossection extends downward over a fixed guide rail attached to said balustrade, d) an electronic proximity sensor associated with each said guide rail and juxtaposed the under surface of said handrail whereby said proximity sensor senses the proximity of said handrail undersurface.

2. In an escalator wherein said escalator includes a pair of parallel balustrades, a moving handrail associated with each of said balustrades, each handrail comprising a "C" shaped crossection wherein the open portion of said "C" shaped crossection extends over a fixed guide rail attached to each said balustrade, the improvement comprising an electronic proximity sensor positioned below said handrail, whereby said proximity sensor will detect the separation of said handrail from said guide rail and emit an electronic signal if said handrail becomes detached from said guide rail.

3. The improvement as claimed in claim 2 wherein said handrail includes at least one, continuous, metallic wire embedded within said handrail and said electronic proximity sensor is an inductive proximity sensor.

4. The improvement as claimed in claim 2 wherein said electronic proximity sensor is an ultrasonic proximity sensor.

5. An escalator for the conveyance of passengers from the entry end of said escalator to the exit end of said escalator, said escalator comprising:

a) a pair of parallel balustrades, b) a guide rail affixed to each balustrade for receipt thereupon a moving handrail, c) said, guide rail and handrail having a concave transition section whereby said, guide rail, and handrail transitions from a horizontal plane to an inclined plane, d) an electronic proximity sensor, positioned below said handrail, within said transition section, whereby said proximity sensor will detect the separation of said handrail from said guide rail and emit an electronic signal if said handrail becomes detached from said guide rail.

* * * * *